United States Patent [19]

Hope, Jr. et al.

[11] 4,311,252

[45] Jan. 19, 1982

[54] NAPKIN DISPENSER

[75] Inventors: Samuel N. Hope, Jr., Wauwatosa; Edwin A. Filipowicz, Greenfield, both of Wis.

[73] Assignee: Griffith-Hope Company, Milwaukee, Wis.

[21] Appl. No.: 56,782

[22] Filed: Jul. 11, 1979

[51] Int. Cl.[3] ..... B65H 1/12

[52] U.S. Cl. ..... 221/57; 221/59

[58] Field of Search ..... 221/63, 59, 57, 226, 221/227, 230, 232, 279, 52–54; 312/61; 271/18, 23, 24

[56] References Cited

U.S. PATENT DOCUMENTS

| | | | |
|---|---|---|---|
| 1,318,317 | 10/1919 | Elsas | 221/279 X |
| 1,505,688 | 8/1924 | Arelt | 221/57 |
| 1,965,060 | 7/1934 | Shapiro | 221/226 X |
| 1,975,557 | 10/1934 | Shaffer | 221/59 X |
| 2,435,104 | 1/1948 | Solomon | 221/59 X |
| 3,777,931 | 12/1973 | Fleming | 221/57 |
| 3,831,809 | 8/1974 | Knickerbocker | 221/227 |
| 4,090,442 | 6/1978 | Radek | 221/59 |

*Primary Examiner*—Stanley H. Tollberg

*Attorney, Agent, or Firm*—Andrus, Sceales, Starke & Sawall

[57] ABSTRACT

A large capacity elevator-type napkin dispenser comprising an elongated supporting structure or cage composed of a series of spaced rod-like vertical supports. A stack of folded napkins is supported on a pressure plate that is mounted on a carriage adapted to slide vertically within the cage. The pressure plate is supported from the carriage by a plurality of compression springs which enable the pressure plate to float and accommodate the varying thickness of the stack of folded napkins. A cover is mounted on the upper end of the cage and has an opening through which the napkins are dispensed. The pressure plate and stack of napkins are urged upwardly toward the undersurface of the cover by a biasing mechanism that includes a pair of extension springs. The springs have a varying spring rate so that the force of the springs will be greatest when the pressure plate is fully loaded with napkins.

4 Claims, 10 Drawing Figures

NAPKIN DISPENSER

BACKGROUND OF THE INVENTION

In fast food establishments and cafeterias, it is often desired to have a napkin dispenser which will hold hundreds of folded napkins. Dispensers of this type can take the form of a free-standing or floor model which rests on the floor or a counter model which is mounted within the counter. In either case, the dispenser includes an elongated vertical supporting structure or frame which will contain up to perhaps 800 folded napkins.

Large capacity napkin dispensers of this type include a cover having an opening through which the napkins are dispensed. To insert the napkins within the dispenser, the cover, which is usually hinged to the frame, is pivoted to an open position and the operator inserts packs of napkins into the dispenser until the dispenser is filled. The napkins are carried on a pressure plate which is spring biased to an upper position so that the napkins, when the cover is closed, will be urged against the undersurface of the cover. With napkin dispensers of this type, it is desirable to lock or restrain the spring force as the napkins are inserted within the dispenser, and, thus, the dispensers frequently include a mechanism which, when the cover is open, will permit the pressure plate to be depressed as packs of napkins are inserted, but which will lock the pressure plate against upward movement. After the dispenser is filled and the cover is closed, the locking mechanism is automatically released so that the spring force will urge the napkins upwardly against the undersurface of the cover.

U.S. Pat. No. 3,777,931, discloses a napkin dispenser of this type in which an elongated racktype locking bar is employed. During installation of the napkins with the cover open, depressing of the pressure plate will cause the pressure plate to engage the teeth of the rack to hold the pressure plate in the depressed position. When the full quantity of napkins has been installed and the cover is closed, the closing of the cover will move the locking bar laterally to release the teeth from engagement with the pressure plate and enable the spring force to urge the napkins upwardly against the undersurface of the cover.

SUMMARY OF THE INVENTION

The invention is directed to an improved large capacity, elevator-type napkin dispenser. The dispenser includes an elongated vertical supporting structure or cage which is composed of a series of vertical rod-like supports. A stack of napkins is supported on a pressure plate which is located within the cage, and the pressure plate, in turn, is supported on a movable carriage by a pair of coil springs which enable the pressure plate to tilt or freely float relative to the cage to accommodate the varying thickness of the folded napkins.

To mount the carriage and pressure plate for sliding movement within the cage, the carriage is provided with a pair of vertically spaced wire forms, and each wire form has loops at its ends which ride on vertical guide rods that are offset outwardly from the cage.

The upper end of the cage is enclosed by a cover having an opening through which the napkins are dispensed, and the stack of napkins is urged upwardly against the undersurface of the cover by a biasing mechanism that includes a pair of cables that are connected between the carriage and the supporting structure through extension springs which have a varying or graduated spring rate, with the spring force being greatest when the pressure plate is in its lowermost position and fully loaded with a stack of napkins. As the pressure plate is elevated, the force of the springs is progressively decreased.

In one form of the invention, the cover is hinged to the supporting structure, and to load the dispenser, the cover is pivoted to an open position and the pressure plate is depressed as packs of napkins are inserted on the pressure plate. During loading, when the cover is open, a locking mechanism is provided in order to retain the pressure plate in the lowered position and the locking mechanism takes the form of a pair of cooperating jaws which are adapted to engage the cable. One of the jaws is fixed to the supporting structure, while the other jaw is pivotable, and when in the locking position, provides a one-way, cam-type lock in which the cable can move in a direction to lower the pressure plate, but is restrained from moving in the opposite direction so that the pressure plate can be progressively lowered and will be retained in the lowered position.

The locking mechanism is released on pivoting the cover from the open to the closed position and in this regard, an abutment on the cover is positioned to engage an arm on the supporting structure, which in turn, pivots the pivotable jaw to a release position, so that the force of the extension spring will then operate to urge the carriage and the stack of napkins upwardly against the undersurface of the cover.

The locking mechanism provides an infinite degree of locking for the pressure plate, as napkins are being loaded into the dispenser and constitutes a substantial improvement over prior devices using a ratchet-type locking mechanism which includes only a limited number of locking positions for the pressure plate. As the dispenser of the invention provides a positive lock at all positions of the pressure plate, it eliminates any tendency for the pressure plate to jump under the force of the spring while seeking a locking position.

The pressure plate, which supports the stack of napkins, is mounted on the carriage solely by a pair of coil springs and this mounting arrangement enables the pressure plate to tilt from side-to-side or forward-to-aft and provides a floating type of action to accommodate the varying thickness of the folded napkins.

The springs which urge the pressure plate upwardly have a varying spring rate so that the force of the springs will progressively decrease with a decreasing load of napkins on the pressure plate.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
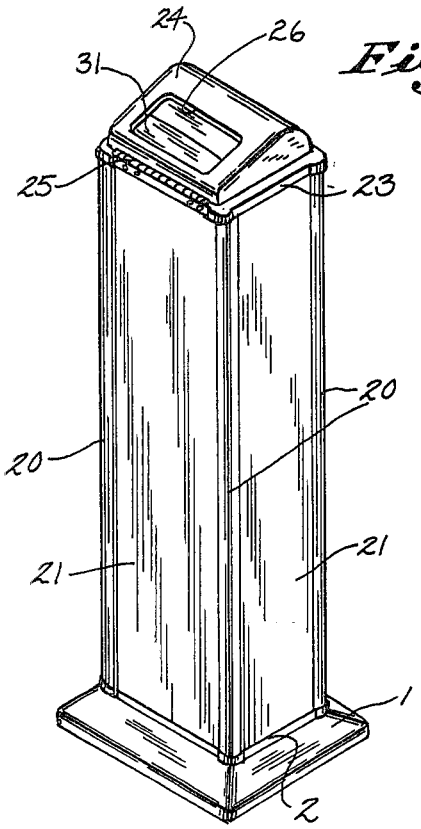
FIG. 1 is a perspective view of a free-standing large capacity, elevator-type napkin dispenser of the invention.
Figure 2:
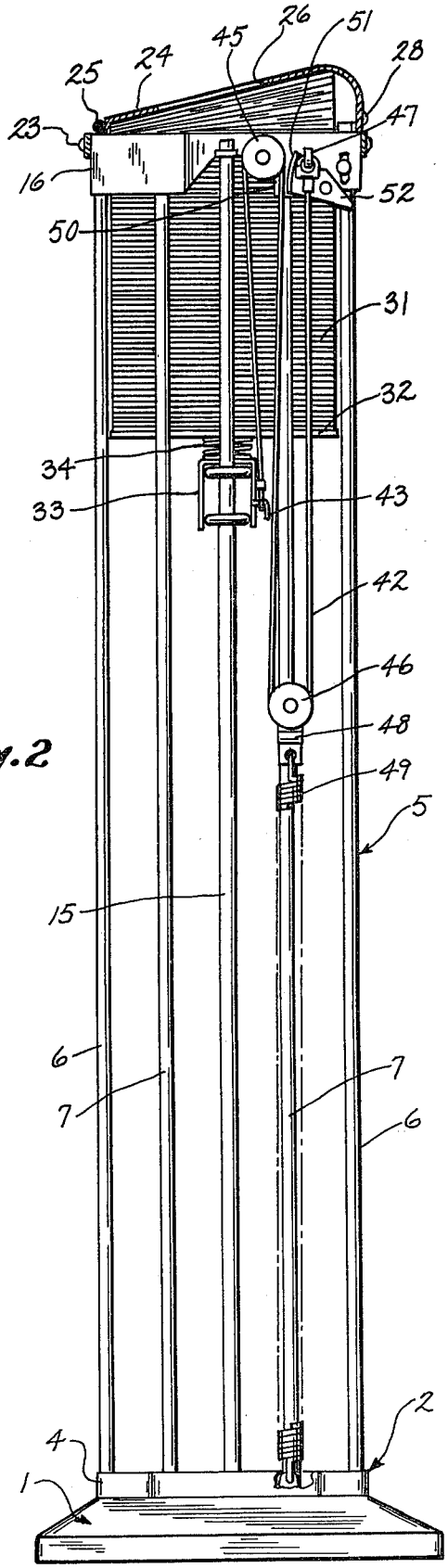
FIG. 2 is a vertical section of the napkin dispenser with the outer housing removed.
Figure 3:
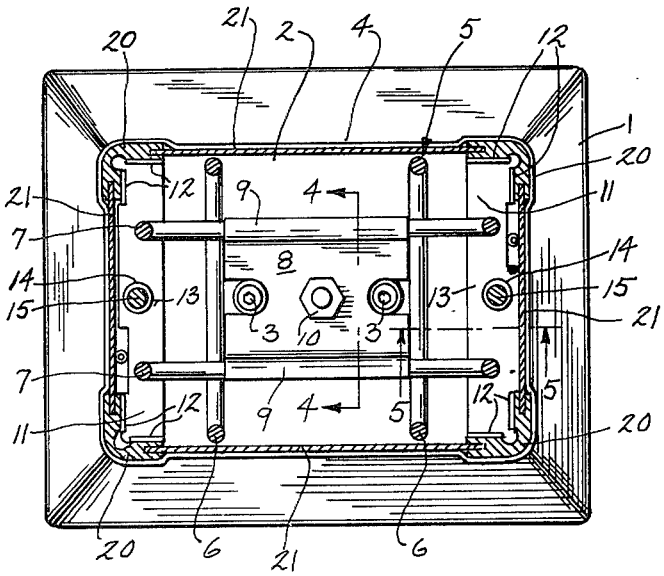
FIG. 3 is a horizontal section showing the base plate construction.
Figure 4:
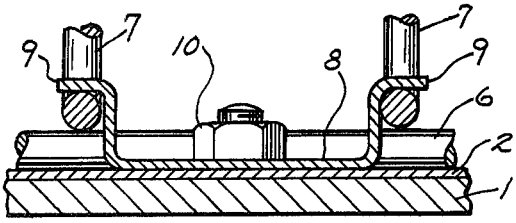
FIG. 4 is a section taken along line 4—4 of FIG. 3.
Figure 5:
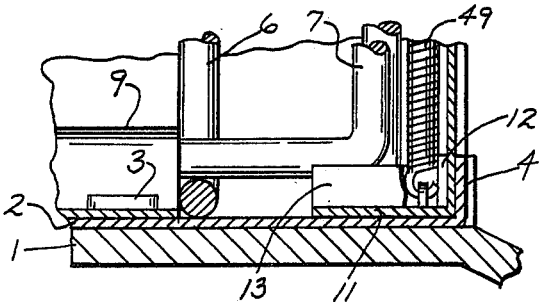
FIG. 5 is a section taken along line 5—5 of FIG. 3.

The drawings show a free-standing or floor model type of napkin dispenser such as that used in fast food establishments or cafeterias. The dispenser includes a weighted base 1 which rests in the ground, and a sheet metal base plate 2 is secured to the base 1 by screws 3. As shown in FIG. 2, the base plate 2 is provided with an upstanding peripheral flange 4.

A vertical wire cage, indicated generally by 5, is supported on the base plate 2, and the cage is composed of a pair of rod-like, generally U-shaped cross members 6 and a pair of similar U-shaped longitudinal members 7. To secure the members 6 and 7 to the base plate 2, a bracket 8 is positioned centrally of the base plate and the horizontal portions of the cross members 6 are positioned against the side edges of the bracket, while the horizontal portions of the longitudinal member 7 rest across the horizontal sections of members 6 and are received within the edge channels 9 of the bracket. The bracket 8 is secured to the base plate through a bolt 10 to thereby position the vertical legs of members 6 and 7 of cage 5 in the proper spaced relationship.

Located inwardly of each end of the base plate 2 is a support plate 11, and each end of each guide support is provided with a pair of upstanding tabs 12 which are spaced from the flange 4 on the base plate 2. The support plate 11 is welded or otherwise secured to the base plate and the central portion 13 of each support plate 11 is offset upwardly and is provided with a hole 14 which receives the lower end of a cylindrical guide rod 15.

Figure 6:
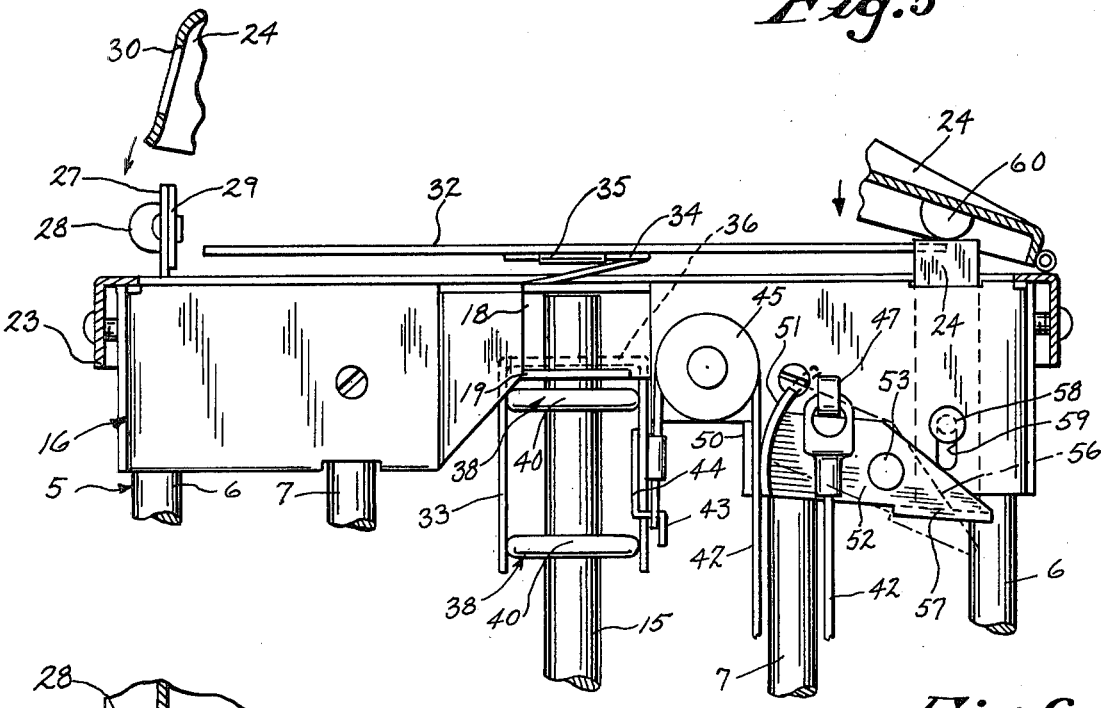
FIG. 6 is an enlarged fragmentary vertical section showing the locking mechanism for the pressure plate.

The cage 5 also includes an upper rectangular support 16 to which the upper ends of the members 6 and 7 are attached. As best shown in FIG. 6, the upper support 16 has a generally channel-shaped cross section, and the upper free ends of the members 6 and 7 are received within notches 17 formed in the lower flange of the support 16 and are secured to the web portion of the support 16 by welding or other fastening means.

Figure 7:
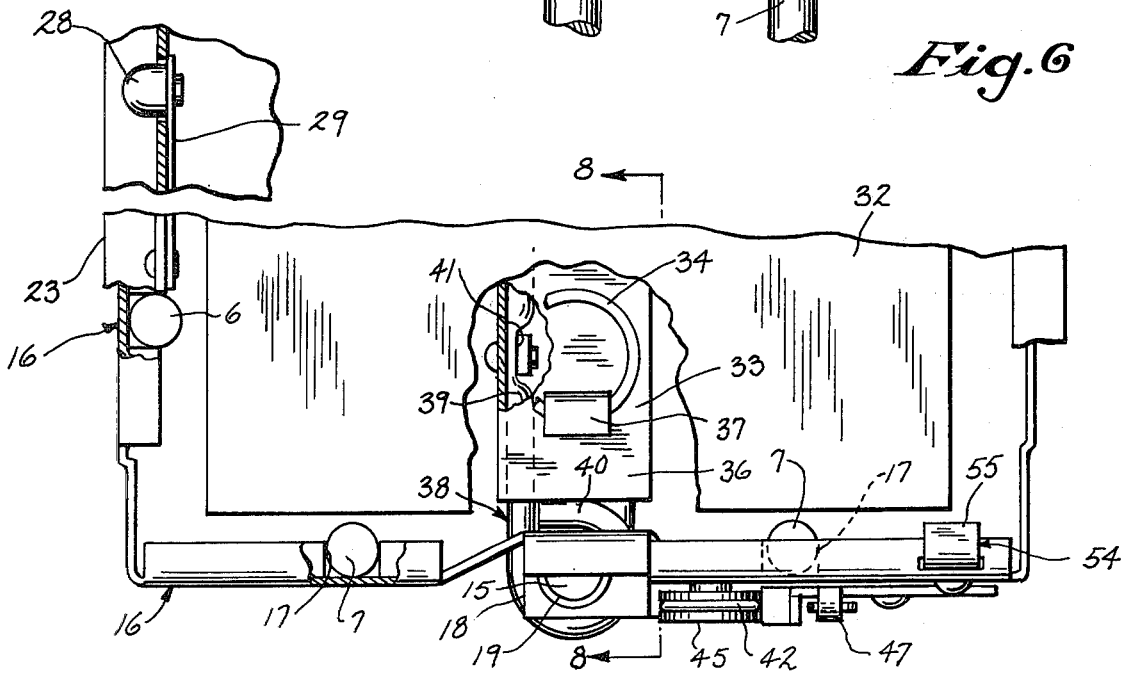
FIG. 7 is a fragmentary top view of the structure shown in FIG. 6 with parts broken away.
Figure 8:
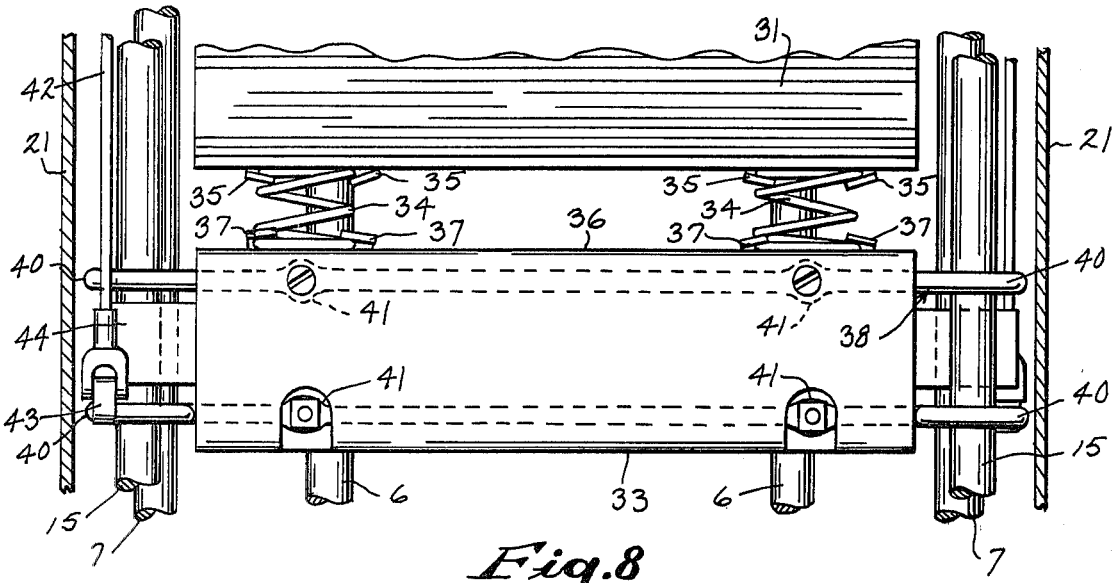
FIG. 8 is a section taken along line 8—8 of FIG. 7.

The vertical guide rods 15 are offset outward of the vertical legs of the members 7, as shown in FIG. 7, and to connect the upper ends of the guide rods to support member 16, the ends of the support member are provided with outwardly facing channel sections 18 and the upper end of each guide rod extends through a hole 19 in the lower flange of the channel section 18 to retain the guide rod in position.

The cage 5 is enclosed by an outer housing which is composed of four vertical corner members 20, and four side panels 21. The lower ends of the corner members are received within the spaces between the upstanding flange 4 on the base plate and the tabs 12 on the supports 11, and the vertical side edges of the corner members 20 are formed with slots 22 which receive the side edges of the panels 21. As illustrated in FIG. 6, the upper ends of the corner members 20 and the upper edges of the panels 21 are secured to the upper support 16 through a collar 23, which is connected to the support member through a plurality of screws.

A cover 24 is hinged to one of the side edges of collar 23 by hinge 25, and the cover 24 is provided with a central opening 26 through which the napkins are to be dispensed. To lock the cover 24 to the collar 23, one edge of the collar is provided with an upstanding flange 27, and a detent 28, which is carried by one end of a leaf spring 29 that is secured to the inner surface of the flange 27, extends through an opening in the flange and is adapted to be received within a hole 30 in the peripheral edge of the cover. As the cover is closed, the rounded outer end of the detent 28 will ride against the edge of the cover, depressing the detent against the force of the spring 29, and the detent which will then snap into engagement with the hole 30 to lock the cover to the collar.

In accordance with the invention, a stack of napkins 31 are supported by a floating pressure plate 32 which is guided for movement within the vertical legs of the members 6 and 7 of cage 5. The pressure plate 32 is supported above a channel-shaped carriage 33 by a pair of coil springs 34. Plate 32 is provided with two pair of punched out tabs 35 which receive the upper ends of springs 34 and similarly, the web portion 36 of carriage 33 is provided with punched out tabs 37 which receive and secure the lower end of springs 34. As the springs 34 constitute the sole support for the pressure plate 32, the pressure plate can float within the cage in order to accommodate the varying thickness of the stack of napkins. Each individual napkin will vary in thickness from end-to-end and side-to-side depending upon the number and nature of folds. Because of this, there can be a considerable different in thickness of the stack from side-to-side or end-to-end and the floating pressure plate 32 will accommodate this variation in stack thickness.

The carriage is mounted for sliding movement on the guide rods 15 by a pair of vertically spaced wire forms 38. Each wire form 38 is provided with a central rod-like section 39 which terminates at each end in a ring 40 which receives the respective guide rods. Each rod-like section 39 is formed with a pair of flat areas 41 which can be secured to the vertical flange of the channel-shaped carriage 33. As shown in FIG. 6, one of the wire forms 38 is secured to one of the side flanges of the carriage, while the other wire form is secured to the opposite flange in order to provide a balanced effect and prevent jamming of the rings 40 on the guide rods 15, as the carriage 33 is raised and lowered. Holes 14 and 19 are oversized so that the guide rods can move freely within the holes in a lateral direction to prevent binding of the carriage.

The invention includes a mechanism to bias the pressure plate 32 to an upper position, and as the pressure plate is lowered by the insertion of a stack of napkins, the pressure plate will be locked in the lowered position. As the dispenser is designed to contain approximately 800 napkins, the locking mechanism enables the operator, with the cover 24 open, to place a stack of napkins on the pressure plate and depress the pressure plate, and the pressure plate will be held in the depressed position until the operator can place a second stack of napkins on the original stack. Thus, the dispenser is loaded in increments, and the pressure plate and carriage will be automatically locked as the pressure plate is lowered.

To bias the pressure plate 32 upwardly toward the opening 26 in the cover 24, a pair of cables 42 are secured on each side of the carriage to tabs 43 on extensions 44 that extends outwardly from the side flanges of the carriage 33. Each cable 42 extends upwardly over a pulley 45 that is mounted for rotation on the upper support member 16, and then downwardly around a second pulley 46 and is dead-ended on tab 47 on the upper support member 16. As best illustrated in FIG. 2, the pulley 46 is mounted on a bracket 48, and an extension spring 49 is connected between the bracket 48 and the lower support plate 11. Thus, the force of the springs 49 will act to urge the carriage 33 and pressure plate 32 upwardly.

Springs 49 are designed with a varying spring rate so that the force of the springs will be greatest when they are in an extended condition when the pressure plate is at its lowermost position within the cage 5. As the pressure plate 32 is raised, the springs 49 will contract so that the spring force will be at its smallest magnitude when the pressure plate is at its uppermost position within the cage.

To automatically lock the pressure plate in position as it is lowered by the insertion of a stack of napkins, the wire or cable 42 passes between a pair of clamping jaws 50 and 51. The jaw 50 is fixed to the upper support member 16, and extends generally parallel to the cable 42. Jaw 51 has a generally curved configuration and is located at the outer end of a bracket 52 which is pivoted to the upper support member 16 at pivot 53. The clamping surface of jaw 51 is knurled or roughened so that it can effectively grip the cable 42. As the jaw 51 is pivoted counterclockwise or downwardly, as shown in FIG. 6, the jaw 51 will be brought into engagement with the cable to grip the cable with a camming or wedging action. Pivotal movement of the jaw 51 in the opposite or clockwise direction will release the clamping action. This construction provides a one-way lock to permit the cable 42 to move upwardly between the closed jaws 50 and 51 as the pressure plate 32 is lowered, but prevents the cable from moving in the opposite direction under the force of the spring 49 so that the pressure plate will be locked in the lowered position. Thus, as each small stack or bundle of napkins is placed on the pressure plate and the pressure plate is lowered, the cable will freely pass between the jaws 50 and 51 to permit lowering of the pressure plate. When manual pressure is released, the cable will not be able to move in the opposite direction so the pressure plate will be retained in its lowered position.

The jaw 51 is automatically moved to a release position on closing of the cover. In this regard, a pair of latches 54 are mounted for sliding movement relative to the upper support member 16. As shown in FIG. 6, the upper end of each latch 54 is formed with a flange 55 while the lower diagonal edge 56 of each latch is disposed in engagement with the flange 57 on the respective pivot bracket 52.

To mount the latch 54 for sliding movement relative to the upper support member 16, a rivet 58 is connected to the latch and extends through a vertical slot 59 in the web portion of the support member 16.

As the cover 24 is moved to its closed position, abutments 60 located at diagonally opposite locations on the undersurface of the cover will engage the respective flanges 55 of latches 54 to move the latches downwardly, thereby pivoting each bracket upwardly, as shown by the phantom position in FIG. 6, and moving the respective jaw 51 to the release position. With the jaw 51 released, the springs 49 will then act to urge the pressure plate upwardly to a position where the uppermost napkin in the stack will engage the undersurface of the cover. As the napkins are progressively withdrawn through the opening 26, the force of the spring will continuously urge the napkins against the undersurface of the cover.

While the above description has shown the napkin dispenser as a free standing floor model, it is also contemplated that the dispenser can be used as a countertop model in which the cage 5, with or without the outer housing, can be located within an opening in the counter. In this case, the weighted base 1 would not be required and the collar 23 would be provided with an outwardly extending flange which would be secured to the upper surface of the counter.

Figure 9:
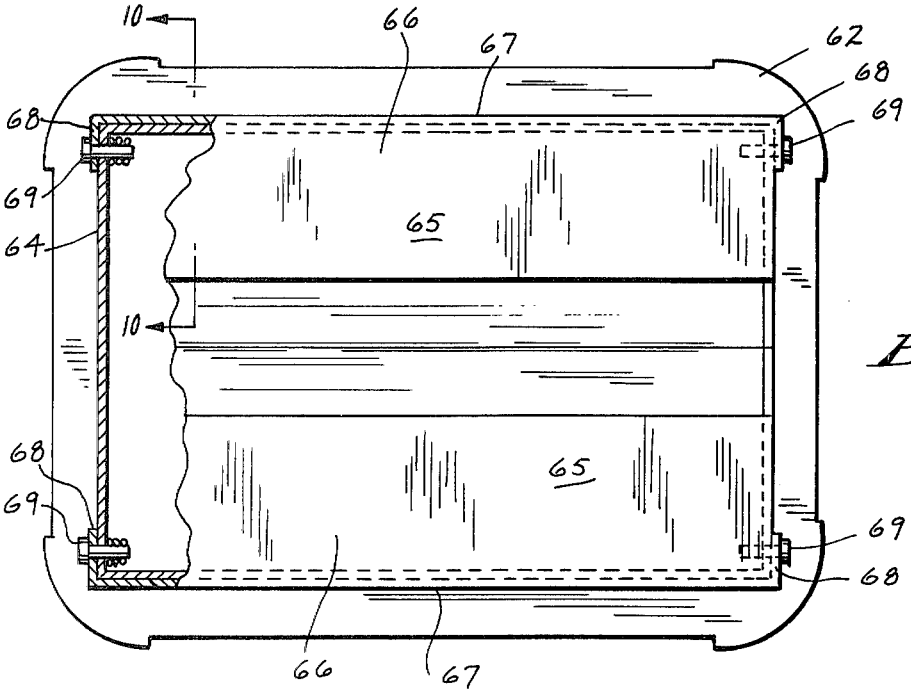
FIG. 9 is a top plan view of a modified form of the invention utilizing a pair of hinged cover sections.
Figure 10:
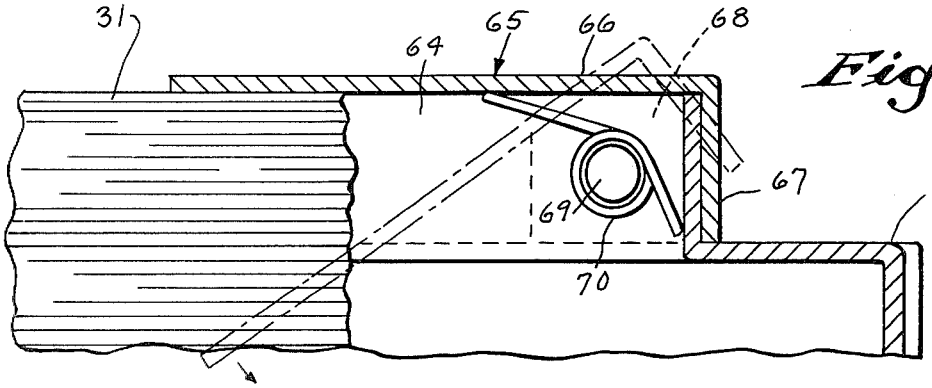
FIG. 10 is a section taken along line 10—10 of FIG. 9.

FIGS. 9 and 10 illustrate a modified form of the invention in which the cover is provided with hinged lid sections. As shown in FIG. 9, the collar 62, which corresponds to the collar 23 of the first embodiment, is provided with a central opening 63 bordered by an upstanding flange 64. A pair of cover sections 65 are hinged to the opposite portions of the flange 64, in a manner such that the cover sections can be pivoted inwardly as a bundle of napkins is inserted into the dispenser. More specifically, each cover section 65 is provided with a central plate 66, a rear flange 67 and a pair of side tabs 68. As shown in FIG. 9, the side tabs 68 are pivoted to the flange 64 by pins 69.

To urge each cover section 65 to an upper or closed position, a torsion spring 70 is utilized, and one end of each spring bears against the flange 64 of collar 62, while the opposite end of the spring bears against the undersurface of the cover section 66, thereby urging the cover section to an upward position. Engagement of the lower end of the rear flange 67 with the upper surface of the collar limits the upper or closed position of the cover section, as shown in FIG. 10.

To insert a bundle of napkins into the dispenser, the operator pushes downwardly against the cover sections 65, causing the cover sections to pivot inwardly to an open position, as shown by the phantom lines in FIG. 10. When the operator withdraws his hand, the cover sections will pivot back to their original closed position under the force of the torsion springs 70 to hold the napkins within the dispenser.

The dispenser of the embodiment shown in FIGS. 9 to 10, utilizes the identical biasing arrangement as shown in the first embodiment in which the springs 49 will urge the pressure plate 32 upwardly toward the undersurface of the cover sections 65. However, this embodiment does not require the locking mechanism, such as provided by jaws 50 and 51, due to the fact that the cover section itself will provide a stop to prevent the stack of napkins being ejected from the dispenser under the force of the spring.

The embodiment shown in FIGS. 9 to 19 also utilizes the identical cage and frame construction as described with respect to the first embodiment.

The dispenser of the invention is adapted to contain a substantial quantity of napkins, generally around 800, depending on the size of the napkins. Because of this, the dispenser has particular application for use in fast food establishments and cafeterias.

The guide system, as utilized in the dispenser of the invention, provides a smooth and more dependable sliding operation for the pressure plate than that utilized by prior types of dispensers. The pressure plate is supported solely by the coil springs 34 which provide a free floating action for the pressure plate to accommodate for variations in the napkin thickness.

Furthermore, the springs 49 are provided with a varying spring rate, so that the force of the springs will progressively decrease as the pressure plate moves upwardly with a decreasing load of napkins.

The locking mechanism provided by jaws 50 and 51, as illustrated in the first embodiment, provides an infinite degree of locking. In prior art types of dispensers, locking was provided through the use of ratchet teeth which were spaced along the length of the locking member and the ratchet tooth system provides only a limited number of locking positions for the pressure plate. In contrast, the present device provides a positive lock at all positions of the pressure plate, thereby eliminating any tendency for the pressure plate to jump under the force of the springs until it finds a locking position.

The wire cage frame construction is a less expensive framework than that employed in prior types of dispensers and due to the cylindrical or rod-like nature of the frame members 6 and 7, provides less frictional resistance to the movement of the stack of napkins. Further, the cage is adaptable for various sizes of folded napkins.

Various modes of carrying out the invention are contemplated as being within the scope of the following claims particularly pointing out and distinctly claiming the subject matter which is regarded as the invention.

We claim:

1. A large capacity elevator-type napkin dispenser, comprising a supporting structure, a cover connected to the upper end of the supporting structure and having an opening through which napkins are dispensed, support means mounted within the support structure for vertical movement therein and including a carriage, a stack of napkins to be supported on said support means, a cable having one end connected to the carriage and the opposite end operably connected to said supporting structure, biasing means for urging the carriage upwardly toward the opening in the cover to urge the stack of napkins against the undersurface of the cover, one-way locking means disposed to engage the cable when the cover is in an open position, said locking means being arranged to permit free movement of the cable in one direction to permit descent of the carriage within the support structure and said locking means being arranged to prevent movement of the cable in the opposite direction and thereby prevent upward movement of the carriage within the support structure, and release means responsive to movement of the cover from the open to the closed position to release said locking means and thereby permit free movement of the cable in both directions.

2. The dispenser of claim 1, wherein said locking means includes a first jaw fixed to the supporting structure, and a pivotable jaw pivotally mounted on said supporting structure for movement between a locking position and a release position, said cable being disposed between said jaws.

3. The dispenser of claim 2, wherein said release means includes an arm extending upwardly from said support structure and disposed to be engaged by the cover when the cover is moved to the closed position, movement of said arm acting to pivot said pivotal jaw to the release position.

4. A large capacity elevator-type napkin dispenser, comprising an elongated vertical support structure composed of a series of spaced rod-like vertical supports defining a cage, a pressure plate mounted for sliding movement within the cage and adapted to support a stack of napkins, a carriage to support said pressure plate, a pair of guide rods disposed parallel to said vertical supports and located at opposite sides of said cage, a pair of vertically spaced wire forms connected to the carriage, each wire form having loops at opposite ends to receive the respective guide rods, said loops providing free sliding movement of the carriage relative to the guide rods without jamming and said rod-like supports providing minimum frictional resistance to the movement of the stack of napkins within the cage.

* * * * *